US009724572B2

(12) United States Patent
Mizutani et al.

(10) Patent No.: US 9,724,572 B2
(45) Date of Patent: Aug. 8, 2017

(54) GOLF CLUB

(71) Applicant: DUNLOP SPORTS CO. LTD., Kobe-shi, Hyogo (JP)

(72) Inventors: Naruhiro Mizutani, Kobe (JP); Kiyofumi Matsunaga, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/026,839

(22) PCT Filed: Oct. 2, 2014

(86) PCT No.: PCT/JP2014/076391

§ 371 (c)(1),
(2) Date: Apr. 1, 2016

(87) PCT Pub. No.: WO2015/050196

PCT Pub. Date: Apr. 9, 2015

(65) Prior Publication Data

US 2016/0263446 A1 Sep. 15, 2016

(30) Foreign Application Priority Data

Oct. 3, 2013 (JP) ..... 2013-208148

(51) Int. Cl.
*A63B 53/02* (2015.01)
*A63B 53/04* (2015.01)
(Continued)

(52) U.S. Cl.
CPC ..... *A63B 53/02* (2013.01); *A63B 53/04* (2013.01); *A63B 53/0466* (2013.01);
(Continued)

(58) Field of Classification Search
CPC ... A63B 53/02; A63B 53/06; A63B 2053/025; A63B 2053/026; A63B 2053/023; A63B 2053/022; A63B 2053/027
(Continued)

(56) References Cited

U.S. PATENT DOCUMENTS

2010/0197423 A1 8/2010 Thomas et al.
2011/0195798 A1 8/2011 Sander et al.
(Continued)

FOREIGN PATENT DOCUMENTS

CN 102527005 A 7/2012
JP 2013-500059 A 1/2013
(Continued)

OTHER PUBLICATIONS

International Search Report for PCT/JP2014/076391 mailed on Dec. 22, 2014.
(Continued)

*Primary Examiner* — Benjamin Layno
(74) *Attorney, Agent, or Firm* — Birch, Stewart, Kolasch & Birch, LLP

(57) ABSTRACT

This golf club includes a shaft, a golf club head, a first adapter, a second adapter, and a fixing member that fixes the first adapter in an interior space of a hosel portion. The shaft is configured to be coupled with an inclination relative to the coupling portion of the first adapter, and the first adapter is configured to be coupled with an inclination relative to the second adapter.

12 Claims, 11 Drawing Sheets

(51) Int. Cl.
*A63B 53/06* (2015.01)
*A63B 71/06* (2006.01)

(52) U.S. Cl.
CPC ..... *A63B 53/06* (2013.01); *A63B 2053/022* (2013.01); *A63B 2053/023* (2013.01); *A63B 2053/025* (2013.01); *A63B 2053/026* (2013.01); *A63B 2053/027* (2013.01); *A63B 2071/0694* (2013.01)

(58) Field of Classification Search
USPC ..... 473/305, 307, 309, 310, 311, 314
See application file for complete search history.

(56) References Cited

U.S. PATENT DOCUMENTS

| | | | | |
|---|---|---|---|---|
| 2012/0034994 | A1 | 2/2012 | Knutson et al. | |
| 2012/0100926 | A1* | 4/2012 | Golden ..... | A63B 53/02 473/307 |
| 2012/0165111 | A1 | 6/2012 | Cheng | |
| 2013/0130834 | A1 | 5/2013 | Stites et al. | |
| 2013/0184098 | A1 | 7/2013 | Boyd et al. | |

FOREIGN PATENT DOCUMENTS

| | | | |
|---|---|---|---|
| JP | 2013-39367 | A | 2/2013 |
| JP | 2013-180038 | A | 9/2013 |

OTHER PUBLICATIONS

Written Opinion of the International Searching Authority for PCT/JP2014/076391(PCT/ISA/237) mailed on Dec. 22, 2014.

Japanese Office Action for Japanese Application No. 2013-208148, dated Mar. 21, 2017, with an English translation.

Chinese Office Action for Appl. No. 201480054709.8 dated May 2, 2017 (w/ English translation).

* cited by examiner

GOLF CLUB

TECHNICAL FIELD

The present invention relates to a golf club.

BACKGROUND ART

Various methods of coupling a golf club head and a shaft have been proposed in recent years. For example, Patent Literature 1 discloses a golf club in which two adapters are attached between the hosel portion of the golf club head and the shaft so as to make it possible to change the angle of attachment of the shaft to the golf club head. Specifically, it has the following configuration. First, a shaft adapter attached to the shaft is fixed so as to be inclined relative to the shaft. A head adapter attached to the hosel portion is removably attached to the head at one of multiple rotation positions. The shaft adapter is then fitted into the head adapter at an inclined angle relative thereto, and furthermore can be fitted therein at multiple rotation positions. Accordingly, the shaft can be attached to the golf club head at various angles by adjusting the rotation position of the head adapter relative to the hosel portion and the rotation position of the shaft adapter relative to the head adapter. This makes it possible to adjust the lie angle, loft angle, and face angle of the golf club to suit the user's preference.

CITATION LIST

Patent Literature

Patent Literature 1: JP 2013-500059A

SUMMARY OF INVENTION

Technical Problem

However, with the above-described golf club, the shaft adapter is accommodated in the interior space of the hosel portion, and therefore the rotation position at which the head adapter is attached to the hosel portion cannot be viewed from the outside. For this reason, there is a problem in that the user therefore needs to detach and disassemble the two adapters in order to check the rotation position of the head adapter, and this task is troublesome.

The present invention has been achieved in order to solve the above problem, and an object thereof is to provide a golf club that enables the rotation position of an adapter to be viewed without disassembling a coupling structure for coupling a shaft and a golf club head.

Solution to Problem

A golf club according to the present invention includes: a shaft; a golf club head having a hosel portion and an opening portion that is formed on a side opposite to the hosel portion and is in communication with an interior space of the hosel portion, the interior space being open at a shaft attachment hole of the hosel portion, and the golf club head having a hosel coupling portion in a vicinity of an opening of the attachment hole; a first adapter that has a first end portion and a second end portion, the first adapter having a shaft receiving recessed portion to which the shaft is to be fixed and that is open on a first end portion side, the first end portion having a coupling portion, and the second end portion being accommodated in the interior space of the hosel portion through the attachment hole; a second adapter that has a first end portion and a second end portion at respective ends along a first axis and has a through-hole through which the first adapter passes, the first end portion having a first coupling portion that is to be detachably coupled to the coupling portion of the first adapter, and the second end portion having a second coupling portion that is to be detachably coupled to the hosel coupling portion; and a fixing member that detachably fixes the first adapter in the interior space of the hosel portion, wherein the shaft is configured to be coupled with an inclination relative to the coupling portion of the first adapter, the first adapter is configured to be coupled with an inclination relative to the second adapter, the coupling portion of the first adapter and the first coupling portion of the second adapter can be coupled in a plurality of rotation positions about a second axis of the second adapter, the second coupling portion of the second adapter and the hosel coupling portion can be coupled in a plurality of rotation position about an axis, and the coupling portion of the first adapter and the first coupling portion of the second adapter are coupled outside the hosel portion.

Note that although the term "coupled" is used for the relationship between the adapters and the relationship between an adapter and the hosel in this description of the invention, the term "coupled" is intended to merely mean that at least two things are in contact so as to be immobile, and it is not required that the two things do not separate even when external force is applied. Accordingly, besides the term "coupled", the term "engaged" is also sometimes used to express this state.

In the above golf club, the first adapter may have the first end portion and the second end portion at respective ends along the first axis and be formed with a tubular shape along the first axis, and the shaft receiving recessed portion may extend along a second axis that intersects the first axis, and the second adapter may have the first end portion and the second end portion at respective ends along the first axis and be formed with a tubular shape along the first axis, and the through-hole of the second adapter may be formed along a second axis that intersects the first axis.

In the above golf club, the second adapter may be formed with a ring shape, and be arranged along the attachment hole such that at least a portion is exposed to the outside.

In the above golf club, the coupling portion of the first adapter may be formed by a flange portion that projects radially outward, and the flange portion may be coupled to the first coupling portion of the second adapter.

In the above golf club, a protrusion/recession portion may be formed on the flange portion of the first adapter along a circumferential direction, and a protrusion/recession portion that engages with the protrusion/recession portion of the flange portion may be formed on the first coupling portion of the second adapter so as to be visible from the outside.

In the above golf club, a protrusion/recession portion that extends along a circumferential direction of the attachment hole may be formed on the hosel coupling portion, and a protrusion/recession portion that engages with the protrusion/recession portion of the hosel coupling portion may be formed on the second coupling portion of the second adapter.

Advantageous Effects of Invention

With the golf club according to the present invention, the coupling portion of the first adapter and the first coupling portion of the second adapter are coupled outside the hosel portion, and therefore the coupling state of these two adapters is visible from the outside. For this reason, the rotation positions of the adapters can be viewed without disassembling the coupling structure for coupling the shaft and the golf club head, and as a result, it is possible to check the lie angle, the loft angle, the face angle, and the like of the golf club based on the coupling state.

DESCRIPTION OF EMBODIMENTS

Figure 1:
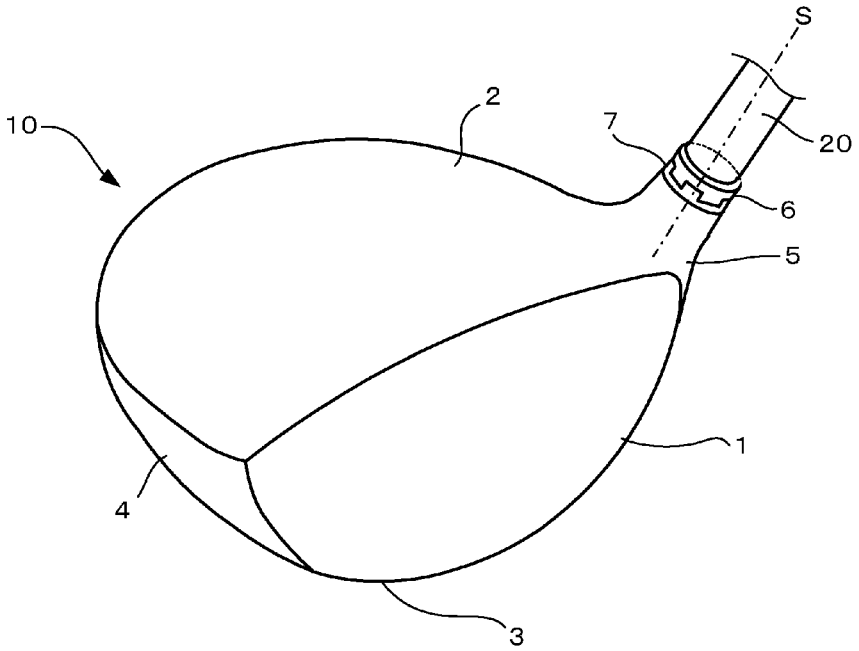
FIG. 1 is a perspective view of a golf club according to an embodiment of the present invention.
Figure 2:
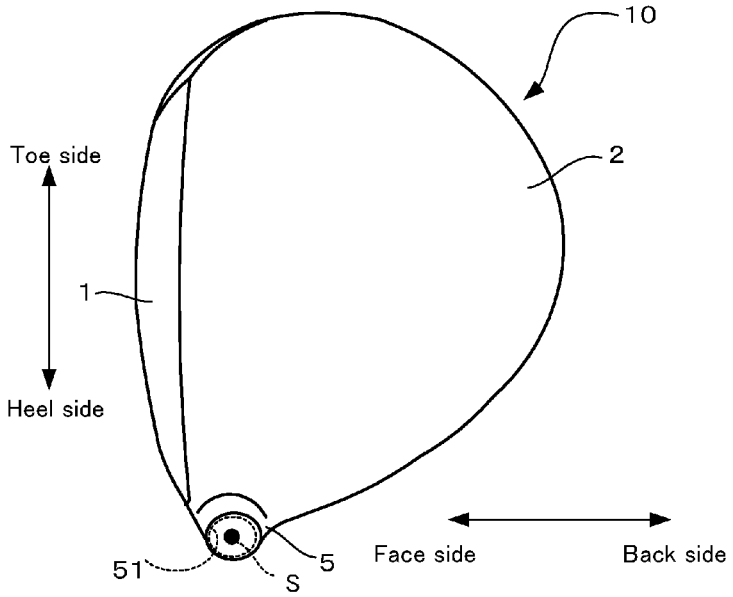
FIG. 2 is a plan view of FIG. 1.

An embodiment of a golf club according to the present invention will be described below with reference to the drawings. FIG. 1 is a perspective view of a golf club head according to the present embodiment, and FIG. 2 is a plan view of FIG. 1. Although the following description uses the orientation shown in the drawings as a reference, this is for the sake of convenience in the description, and this orientation is not intended to limit the invention. Also, the axial direction in the following description is generally the direction in which the shaft extends unless otherwise stated, and is not intended to have a strict definition.

1. Overall Structure of Golf Club

As shown in FIGS. 1 and 2, the golf club of the present embodiment includes a shaft 20 and a golf club head 10 (sometimes referred to hereinafter as simply the "head") coupled to an end portion of the shaft 20. Also, the shaft 20 and the golf club head 10 are coupled together by a later-described coupling structure, and are configured such that it is possible to change the axial rotation position of the shaft 20 relative to the head 10. These members will be described in detail below.

The shaft 20 is shaped as a hollow tube, has a lower end portion to which the above-mentioned golf club head 10 is coupled, and has an upper end portion to which a grip (not shown) is fixed.

The golf club head 10 is a hollow structure and has wall surfaces formed by a face portion 1, a crown portion 2, a sole portion 3, a side portion 4, and a hosel portion 5. The face portion 1 has a face surface, which is the surface for hitting a ball, and the crown portion 2 is adjacent to the face portion 1 and constitutes the upper surface of the head. The sole portion 3 constitutes the bottom surface of the head 10, and is adjacent to the face portion 1 and the side portion 4. Also, the side portion 4 is the portion between the crown portion 2 and the sole portion 3, and extends from the toe side of the face portion 1, across the back side of the head 10, to the heel side of the face portion 1. Furthermore, the hosel portion 5 is a cylindrical portion provided adjacent to the heel side of the crown portion 2, and has an attachment hole 51 for the insertion of a later-described first adapter 6. Note that although the head 10 described here is a wood head such as a driver (#1) or fairway wood head, it is not limited to being a wood head, and may be a so-called utility head, hybrid head, or the like.

2. Coupling Structure for Coupling Shaft and Golf Club Head

Figure 3:
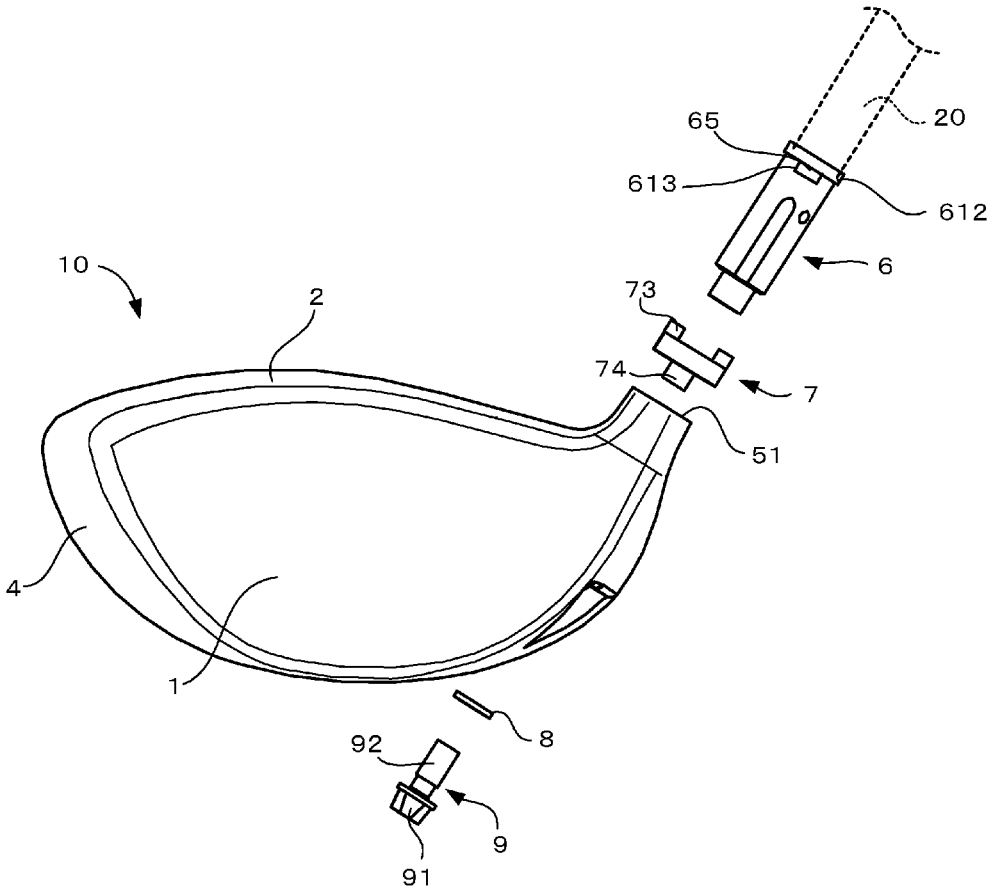
FIG. 3 is an exploded view of a coupling structure.

Next, a coupling structure for coupling the shaft 20 and the golf club head 10 will be described. FIG. 3 is an exploded view of the coupling structure. As shown in this figure, in this coupling structure, the shaft 20 and the golf club head 10 are coupled via the first adapter 6 and a second adapter 7, and these two adapters 6 and 7 are fixed inside the golf club head 10 by a washer 8 and a fastener 9. This coupling structure will be described in detail below.

2.1 Coupling-Related Structure of Golf Club Head

Figure 4:
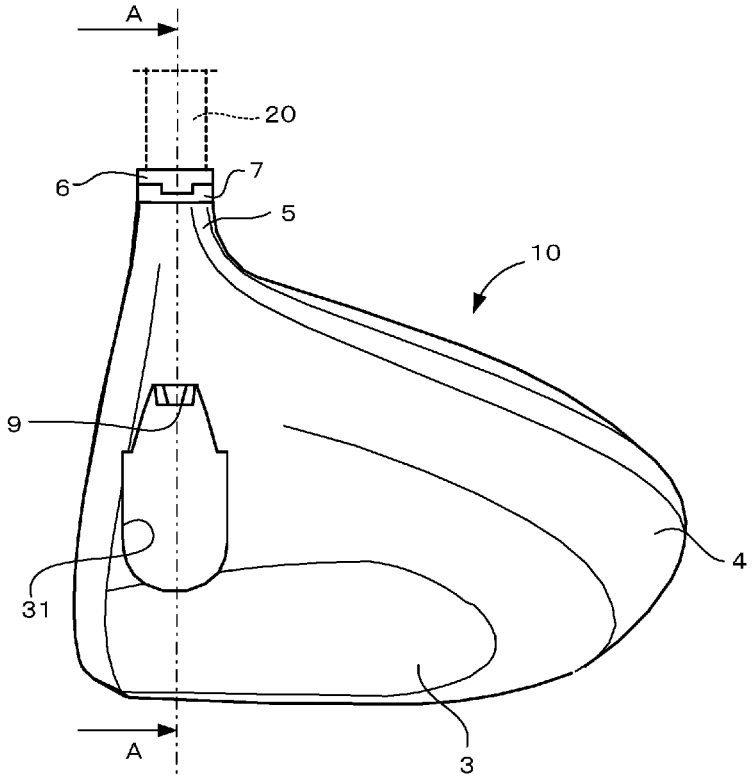
FIG. 4 is a front view of a golf club head with two adapters, a washer, and a fastener mounted therein, as viewed from the heel side.

First, the structure of the golf club head 10 will be described with reference to FIGS. 4 to 6 as well. FIG. 4 is a front view of the golf club head with the two adapters, the washer, and the fastener mounted therein, as viewed from the heel side, FIG. 5 is a cross-sectional view taken along line A-A in FIG. 4, and FIG. 6 is a bottom view of the golf club head in FIG. 4 from the sole portion side.

Figure 5:
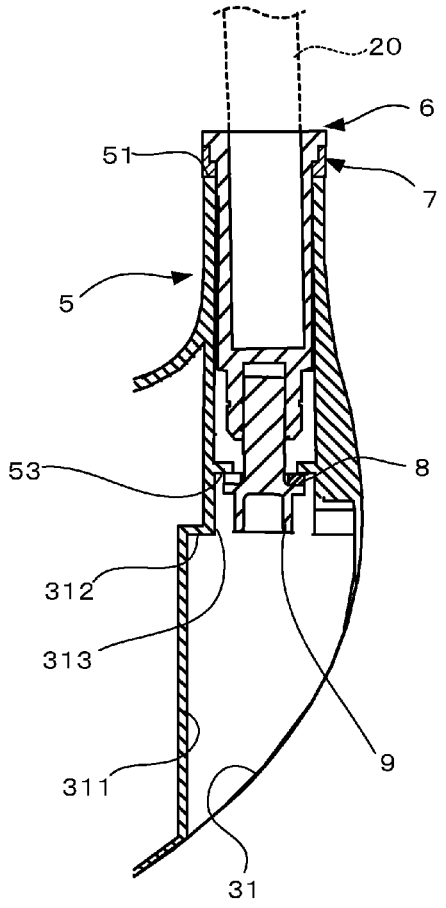
FIG. 5 is a cross-sectional view taken along line A-A in FIG. 4.
Figure 6:
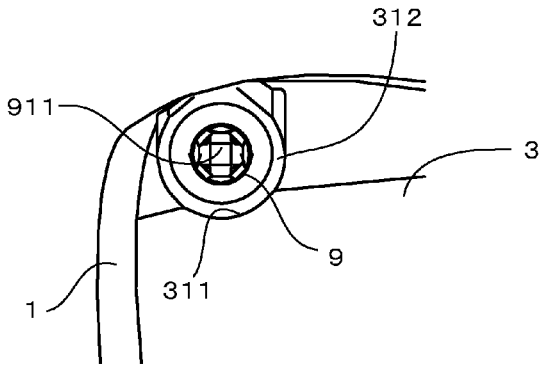
FIG. 6 is a bottom view of the golf club head in FIG. 4 as viewed from the sole portion side.

As shown in FIGS. 4 to 6, the interior space of the hosel portion 5 extends to the side portion 4 side and the sole portion 3 side in a direction generally parallel to the axial direction of the shaft 20. A recessed portion 31 is formed in a portion of the sole portion 3 on the side opposite to the hosel portion 5. This recessed portion 31 is constituted by an arc-shaped side surface 311 that extends substantially parallel to the interior space, and a base surface 312 that extends generally perpendicularly from the side face 311. Also, a lower opening 313 in communication with the interior space is formed in the base face 312.

Figure 7:
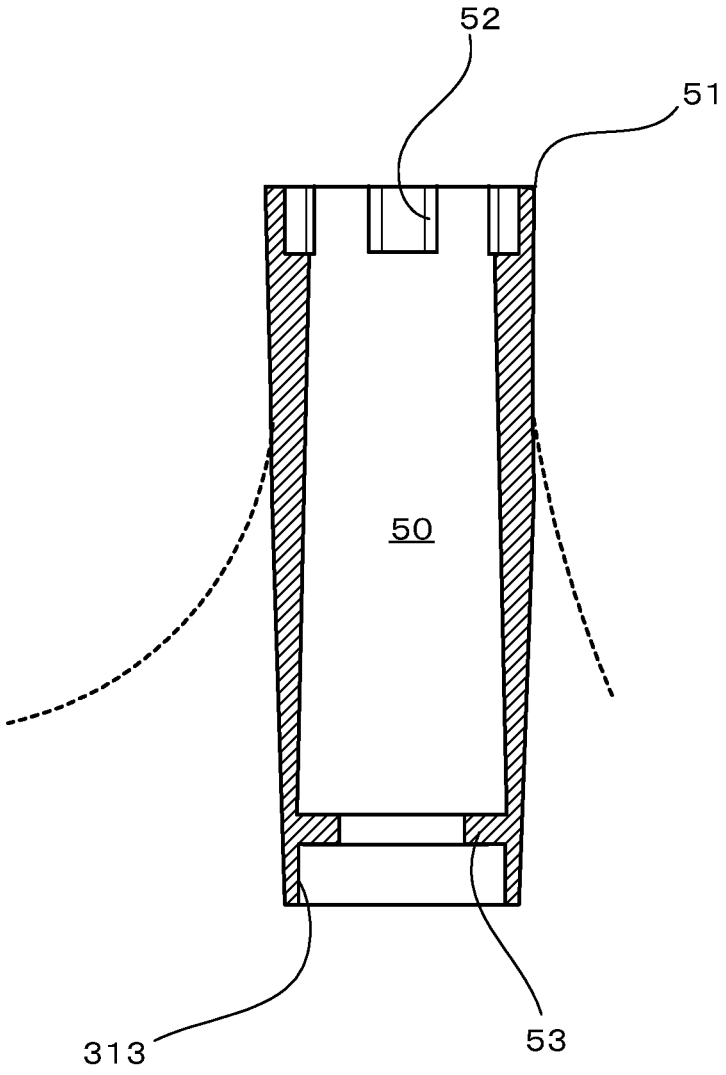
FIG. 7 is a cross-sectional view of the interior space of a hosel portion.

As shown in FIG. 7, an interior space 50 of the hosel portion 5 is formed with a cylindrical shape, the upper portion thereof constitutes the attachment hole 51 of the shaft, and the lower portion thereof constitutes the above-described lower opening 313. The inner wall surface of the interior space 50 is formed with a tapered shape in which the diameter somewhat increases as, it extends from above to below. Also, multiple recessed portions (hosel coupling portions) 52 are formed in the inner wall surface of the attachment hole 51 along the circumferential direction, and second protrusion portions 74 of the later-described second adapter 7 engage with these recessed portions 52. On the other hand, an annular projection portion 53 that projects radially inward is formed on the inner wall surface of the lower opening 313, and the later-described fastener 9 is attached to this projection portion 53. At the time of assembly, after the second adapter 7 has been attached to the attachment hole 51 side, the first adapter 6 is inserted so as to pass through the second adapter 7. The washer 8 and the screw-like fastener 9 are used to fix the first adapter 6 to the above-described projection portion 53 in the interior space 50. As shown in FIG. 3, the fastener 9 is formed by a head portion 91 and a threaded portion 92 coupled thereto, and a rectangular recessed portion 911 (see FIGS. 5 and 6) for the insertion of a wrench is formed in the head portion 91.

2.2 First Adapter

Figure 8A:
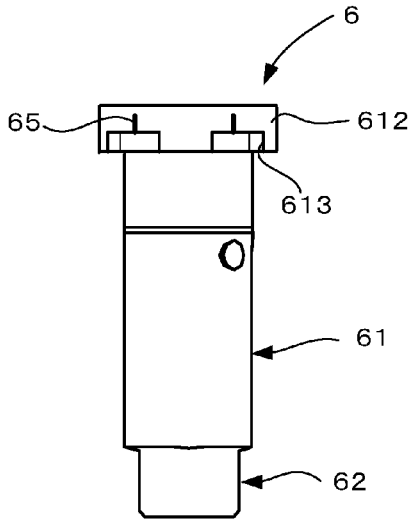
FIG. 8A is a side view of a first adapter.
Figure 8B:
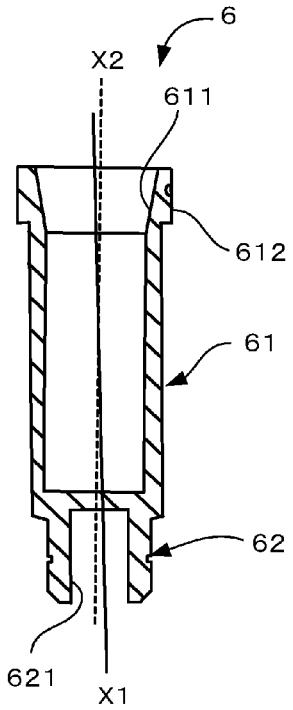
FIG. 8B is a cross-sectional view of the first adapter.

Next, the first adapter 6 will be described with reference to FIG. 8. FIG. 8A is a side view of the first adapter, and FIG. 8B is a cross-sectional view of FIG. 8A. As shown in these figures, the first adapter 6 includes a body portion 61 formed with a tubular shape, a flange portion 612 that projects radially outward is formed on the upper end portion of the body portion 61, and a tubular coupling portion 62 having a smaller diameter than the body portion 61 is formed on the lower end portion of the body portion 61. These members are formed as a single body. The body portion 61 has a first axis X1 as its axial center, is externally shaped so as to extend along the first axis X1 in the shape of a cylinder, and has a shaft receiving recessed portion 611 that is open on the upper end side. This shaft receiving recessed portion 611 has a cylindrical inner wall surface that extends along a second axis X2 that intersects the first axis X1 at an angle of approximately 1 degree, and the lower end portion of the shaft 20 is inserted into this shaft receiving recessed portion 611. The shaft 20 is fixed to the shaft receiving recessed portion 611 by adhesion or the like. Accordingly, the shaft 20 is fixed such that an axial center S (see FIG. 1) thereof extends along the second axis X2 of the first adapter 6 and extends with an inclination from the first adapter 6.

The outer diameter of the body portion 61 of the first adapter 6 is smaller than that of the attachment hole 51 of the hosel portion 5, but the above-described flange portion 612 has a larger diameter than that of the attachment hole 51, and is coupled to the later-described second adapter 7. More specifically, multiple recessed portions 613 that are open downward are formed in the lower end portion of the flange portion 612, and first protrusion portions 73 of the second adapter 7 engage with these recessed portions 613. Accordingly, the flange portion 612 of the first adapter 6 is arranged outside the attachment hole 51, and the portion of the first adapter 6 below the flange portion 612 is arranged in the interior space 50 of the hosel portion 5. Also, by, for example, providing multiple rotation position indicators 65 on the outer peripheral surface of the flange portion 612 as shown in the example in FIG. 4, an angle can be set according to the user's preference, as will be described later, by aligning one of the rotation position indicators 65 with a reference indicator 75 provided on the second adapter 7.

The coupling portion 62 of the first adapter 6 is formed as a tube that extends along the first axis X1, and also has a threaded hole 621 that is open downward, and female threading is formed in this threaded hole 621. Note that the upper end portion of the first adapter 6 in FIG. 8 corresponds to a first end portion of the present invention, and the lower end portion of the first adapter 6 corresponds to a second end portion of the present invention.

2.3 Second Adapter

Figure 9A:
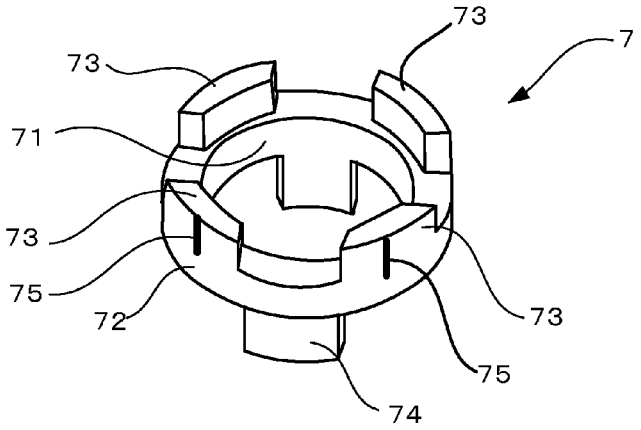
FIG. 9A is a perspective view of a second adapter as viewed from above.
Figure 9B:
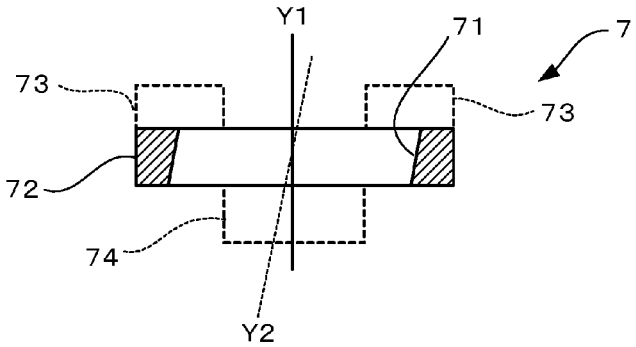
FIG. 9B is a cross-sectional view of the second adapter.
Figure 9C:
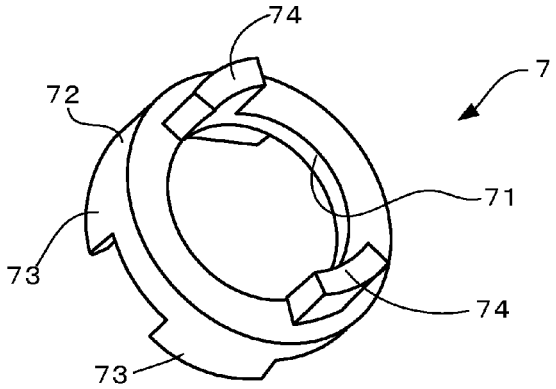
FIG. 9C is a perspective view of the second adapter as viewed from below.

Next, the second adapter 7 will be described with reference to FIG. 9. FIG. 9A is a perspective view of the second adapter as viewed from above, FIG. 9B is a cross-sectional view of the second adapter, and FIG. 9C is a perspective view of the second adapter as viewed from below. As shown in these figures, the second adapter 7 includes a ring-shaped body portion 72 that has a through-hole 71, and is coupled to the upper portion of the attachment hole 51 of the hosel portion 5. The body portion 72 is formed with approximately the same diameter as the attachment hole 51 of the hosel portion 5, and multiple (four in the present embodiment) first protrusion portions 73 arranged at predetermined intervals in the circumferential direction are formed on the upper end of the body portion 72. Also, multiple second protrusion portions 74 that project downward in the axial direction are formed on the lower end of the body portion 72. The second protrusion portions 74 are formed at positions that correspond to the gaps between the first protrusion portions 73, and engage with the recessed portions 52 of the hosel portion 5. Also, the second protrusion portions 74 are attached radially inward of the outer peripheral surface of the body portion 72, and are arranged in the interior space 50 and are not visible from the outside when they are engaged with the recessed portions 52 of the hosel portion 5. Note that the upper end portion of the second adapter 7 in FIG. 9B corresponds to a first end portion of the present invention, and the lower end portion of the second adapter 7 corresponds to a second end portion of the present invention.

Also, the body portion 72 of the second adapter has a first axis Y1 as its axial center, and is externally shaped so as to extend along the first axis Y1 in the shape of a cylinder. The through-hole 71 of the second adapter 7 has a cylindrical inner wall surface that extends along a second axis Y2 that intersects the first axis Y1 at an angle of approximately 1 degree, and the first adapter 6 is removably inserted into this through-hole 71. The inner diameter of this through-hole 71 is approximately the same as that of the body portion 61 of the first adapter 6. The first protrusion portions 73 of the second adapter engage with the recessed portions 613 of the first adapter that was inserted, and thus the two adapters 6 and 7 are coupled so as to be incapable of axial rotation. In this way, the inserted first adapter 6 extends along the second axis Y2 of the second adapter 7, and is thus fixed so as to extend with an inclination from the second adapter 7. At this time, the number of rotation positions at which the two adapters 6 and 7 can be coupled is equal to the number of recessed portions 613 and first protrusion portions 73. Note that the number of recessed portions 613 and first protrusion portions 73 is not particularly limited, and can be set to 2 to 12, for example. Also, in this configuration, the second axis X2 of the first adapter 6 and the second axis Y2 of the second adapter 7 intersect each other, rather than being parallel, when the two adapters 6 and 7 are coupled.

Also, a reference indicator 75 is provided on the outer peripheral surface of the second adapter 7, and is used for positioning with the above-described rotation position indicators 65 of the first adapter 6.

Note that the adapters 6 and 7 used in the coupling structure can be formed from various types of materials such as Ti (6-4Ti) or Al (Al5052).

3. Assembly of Shaft and Golf Club Head

Next, a method of assembling the golf club having the above configuration will be described. First, the second adapter 7 is attached to the attachment hole 51 of the hosel portion 5. At this time, a rotation position for the second adapter 7 is appropriately determined, and the second protrusion portions 74 of the second adapter 7 are fitted into the recessed portions 52 of the attachment hole 51 in the desired rotation position. Accordingly, the second adapter 7 is coupled to the hosel portion 5 so as to be incapable of rotation. Next, the first adapter 6 having the shaft 20 fixed thereto is inserted into the through-hole 71 of the second adapter 7. At this time, the first protrusion portions 73 of the second adapter 7 are fitted into the recessed portions 613 of the flange portion 612 of the first adapter 6, and one of the rotation position indicators 65 is aligned with the reference indicator 75 of the second adapter 7. In this way, the first adapter 6 and the second adapter 7 are coupled so as to be incapable of rotation.

Also, as shown in FIG. 5, the portion of the first adapter 6 below the flange portion 612 is inserted into the interior space 50, and the coupling portion 62 provided on the lower end portion of the first adapter 6 is fixed in the interior space 50. Specifically, the washer 8 is arranged on the projection portion 53 of the interior space 50 from below, and then the threaded portion 92 of the fastener 9 is screwed into the coupling portion 62 of the first adapter 6 from below. At this time, the head portion 91 of the fastener 9 engages with the projection portion 53, and thus the fastener 9 is held in the interior space 50. Also, due to the fastener 9 being screwed into the first adapter 6, the position of the first adapter 6 in the axial direction is fixed in the interior space 50. In this way, the shaft 20 and the head 10 are coupled as shown in FIGS. 1, 2, 4, and 5.

When the shaft 20 and the head 10 have been fixed as described above, the shaft 20 is fixed so as to be inclined at an angle of 1 degree relative to the first adapter 6. Also, the first adapter 6 is fixed so as to be inclined at an angle of 1 degree relative to the second adapter 7. Accordingly, the shaft 20 is fixed so as to be inclined at a maximum of 2 degrees relative to the second adapter 7. In this way, the first adapter 6 is fixed so as to be inclined relative to the second adapter 7 and the attachment hole 51 of the hosel portion 5 in one of the rotation positions, and since the interior space accommodating the first adapter 6 is tapered, the first adapter 6 does not interfere with the inner wall surface of the interior space regardless of the rotation position in which the first adapter 6 is fixed to the second adapter 7.

Here, by changing the rotation position of the first adapter 6 relative to the second adapter 7 while keeping the rotation position of the second adapter 7 relative to the attachment hole 51 fixed, the attachment angle of the shaft 20 relative to the head 10 is changed, thus making it possible to change the lie angle, the loft angle, and the face angle of the head 10. Also, the lie angle, loft angle, and face angle can be changed more finely by changing the rotation angle of the second adapter 7 relative to the attachment hole 51. For example, if there are 4 rotation angles of the first adapter 6 relative to the second adapter 7 and two rotation angles of the second adapter 7 relative to the attachment hole 51, it is possible to make a change to a total of 8 combinations of a lie angle, a loft angle, and a face angle.

At this time, the flange portion 612 of the first adapter 6 and the second adapter 7 are exposed to the outside, and the engagement state of the recessed portions 613 of the flange portion 612 and the first protrusion portions 73 of the second adapter 7 is visible from the outside. Also, the rotation position indicators 65 are provided on the flange portion 612 of the first adapter 6 and are exposed to the outside, and therefore the user can easily view where the rotation position of the first adapter 6 is at. Also, the reference indicator 75 is provided on the second adapter 7 as well, thus making it possible to check the rotation position relative to the hosel portion 5. Accordingly, the user can check the rotation position of the first adapter 6 and the rotation position of the second adapter 7 without disassembling the coupling structure, and thus can check the lie angle, loft angle, and face angle of the golf club.

4. Variations

Although an embodiment of the present invention has been described above, the present invention is not limited to this embodiment, and various modifications can be made without departing from the gist of the invention. The following are examples of modifications that can be made.

4.1

Figure 10:
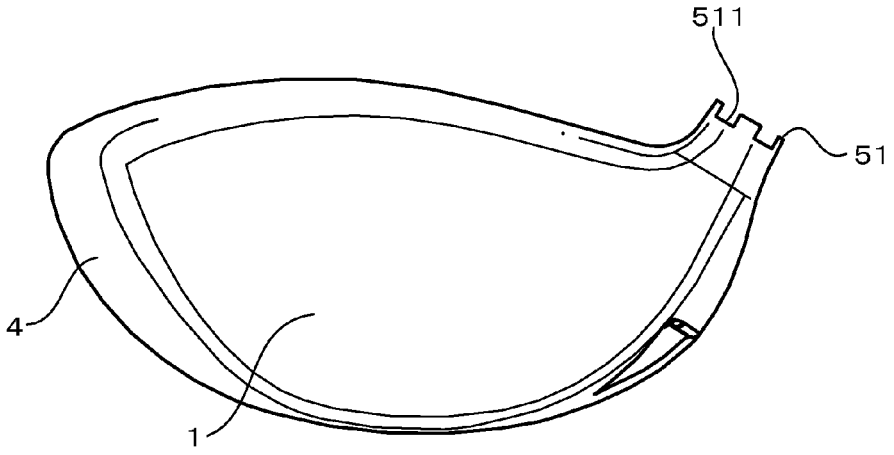
FIG. 10 is a front view of another example of the golf club head.

Although the second protrusion portions 74 of the second adapter 7 are provided so as to be located radially inward of the outer peripheral surface of the body portion 72 in the above embodiment, the outer peripheral surface of the second protrusion portions 74 and the outer peripheral surface of the body portion 72 can be formed so as to be in the same plane. In this case, as shown in FIG. 10, multiple recessed portions 511 are formed along the peripheral edge of the attachment hole 51 of the hosel portion 5, and the second protrusion portions 74 of the second adapter 7 engage with these recessed portions 511. Accordingly, it is easier to see in what rotation position the second adapter 7 is coupled to the hosel portion 5.

4.2

Although the coupling of the second adapter and the attachment hole of the hosel portion and the coupling of the first adapter and the second adapter are realized by engagement of protrusion portions and recessed portions in the above embodiment, a coupling means other than this can be used. For example, the protrusion portions and the recessed portions may be reversed. In other words, this coupling need only be detachable coupling in multiple rotation positions, and coupling so as to be incapable of axial rotation.

4.3

In the above embodiment, the shaft 20 is inclined at an angle of 1 degree relative to the first adapter 6, and the first adapter 6 is inclined at an angle of 1 degree relative to the second adapter 7, but there are no particular limitations on these angles. Also, the two angles may be different.

4.4

Figure 11A:
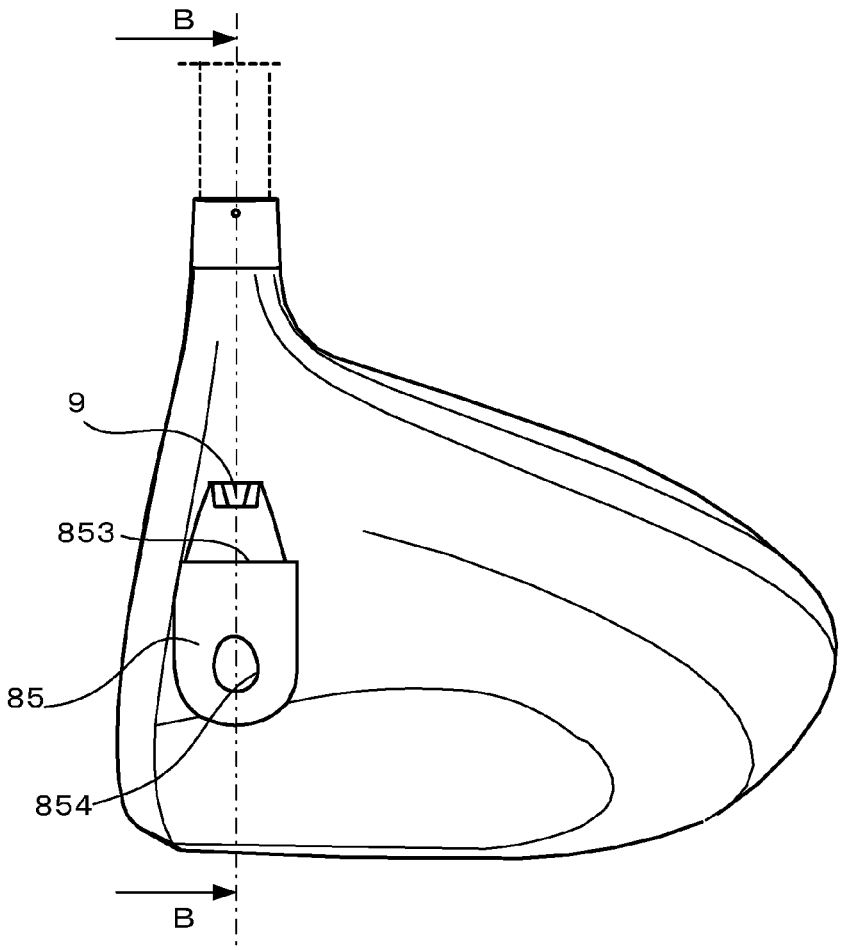
FIG. 11A is a front view of another example of the golf club head in FIG. 4.
Figure 11B:
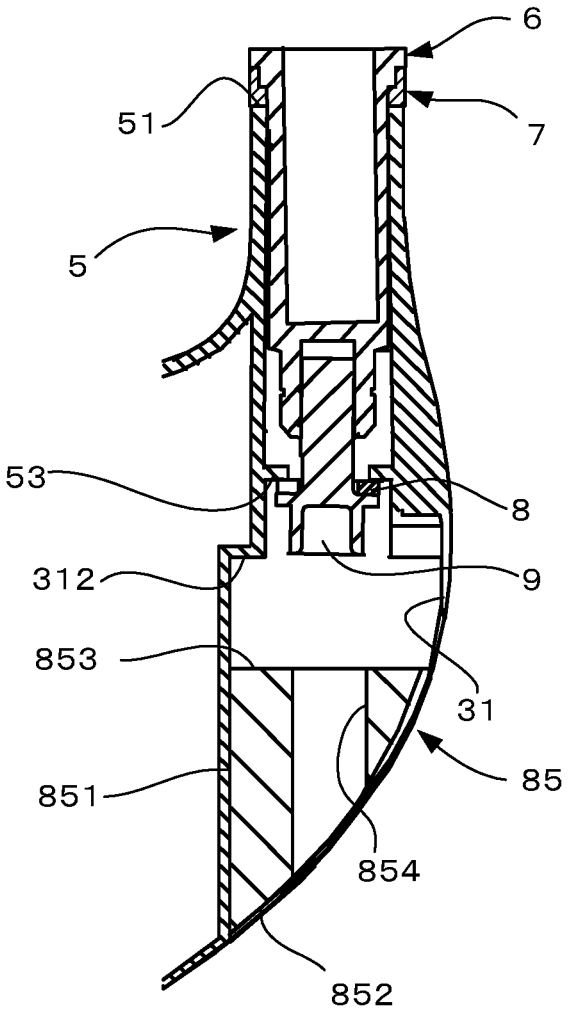
FIG. 11B is a cross-sectional view taken along line B-B in FIG. 11A.

Although the lower opening 313 in communication with the interior space is exposed via the recessed portion 31 formed in the surface of the golf club head 10 in the above embodiment, a cap for blocking the recessed portion 31 may be provided. For example, as shown in FIGS. 11A and 11B, a cap 85 is formed by a side wall surface 851 that extends along the side surface 311 of the recessed portion 31, an outer wall surface 852 that extends along the outer peripheral surface of the golf club head 10, and an end surface 853 that opposes the base surface 312 of the recessed portion 31. The length of the side wall surface 851 in the axial direction is shorter than that of the side surface 311 of the recessed portion 31, and thus a gap is formed between the base surface 312 of the recessed portion 31 and the end surface 853. Also, a through-hole 854 that extends in the axial direction is formed between the outer wall surface 852 and the end surface 853, and a tool such as a wrench can be inserted through this through-hole 54 from outside the cap 85. It is then possible to engage the tool with the head portion 91 of the fastener 9 and detach the fastener 9 while the cap 85 is closed. According to this configuration, the recessed portion 31 is blocked by the cap 85, thus making it possible to improve the designability of the head 10 and prevent loss of the fastener 9 when it is detached.

4.5

Also, although the rotation position indicators 65 and the reference indicator 75 of the first adapter 6 and the second adapter 7 are provided by lines, they can alternatively be provided by graphics, numbers, or the like, and it is alternatively possible to process portions of the adapters 7, such as cutting out portions or providing protruding portions. Note that there is no particular distinction between the rotation position indicator and the reference position, and there are no particular limitations on them as long as rotation position alignment can be performed. In other words, it is sufficient that some sort of indicator is provided, and it is possible to provide the reference position on the first adapter 6 and provide the rotation position indicators on the second adapter 7.

4.6

Although a portion of the head forms the interior space in the hosel portion in the above embodiment, the hosel portion 5 may be constituted by being attached to the golf club head as a separate body as shown in FIG. 7, for example.

4.7

Figure 12:
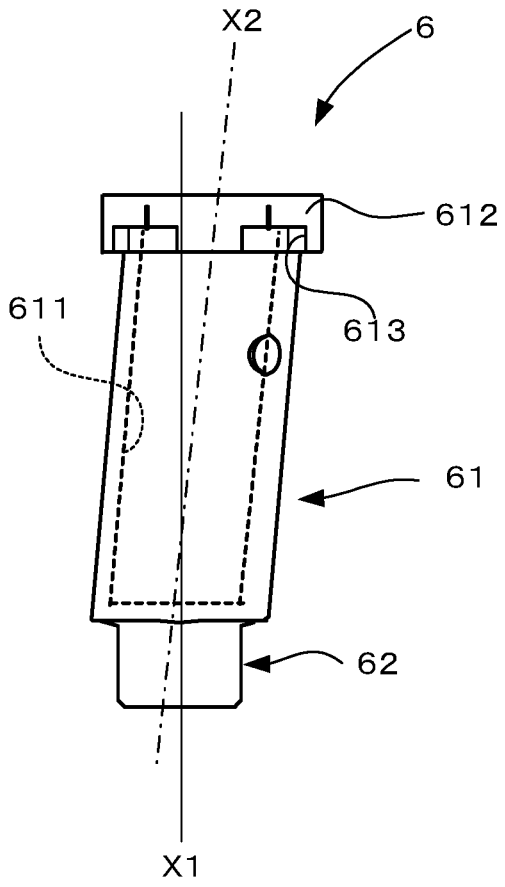
FIG. 12 is a side view of another example of the first adapter.

In the above embodiment, the outer peripheral surface of the first adapter 6 is formed so as to extend parallel to the first axis X1, and the shaft receiving recessed portion 611 is formed so as to extend along the second axis X2 that intersects the first axis X1, but the first adapter 6 can be formed as shown in FIG. 12, for example. As shown in this figure, in this example, the body portion 61 of the first adapter 6 is inclined relative to the flange portion 612 and the recessed portions 613. In other words, the flange portion 612 and the recessed portions 613 are formed so as to extend along the first axis X1, and the outer peripheral surface of the body portion 61 is formed so as to extend along the second axis X2. Also, the shaft receiving recessed portion 611 formed in the body portion 61 is also formed so as to extend along the second axis X2. According to this configuration as well, the axis of the shaft 20 extends along the second axis X2, and therefore the shaft 20 can be fixed so as to be inclined relative to the first adapter 6. Note that in order for the entirety of the flange portion 612 to come into contact with the second adapter 7, the flange portion 612 is formed so as to be inclined relative to the body portion 61. Also, the inclination angle of the flange portion 612 relative to the body portion 61, and the inclination angle of the through-hole 71 in the second adapter 7 may be the same or may be different, which is to say that if two inclinations are provided, the first adapter 6 is coupled in a state of being inclined relative to the second adapter 7.

4.8

Note that since the golf club head configured as described above is a hollow structure, it can be manufactured by joining two or more members together. Specifically, it can be manufactured by joining together a head body provided with one or two or more openings in communication with a hollow portion, and a separate member that blocks these openings. For example, it is possible to constitute the head by constituting only the crown portion 2 and the face portion 1 as separate members and combining them with the head body, or forming the head body such that an opening is provided in the sole portion 3 and the side portion 4 and blocking this opening with a separate member. Also, this head body can be manufactured by casting using a known lost-wax precision casting method, for example.

REFERENCE SIGNS LIST

10 Golf club head
20 Shaft
31 Lower opening
5 Hosel portion
51 Attachment hole
52 Recessed portion (hosel coupling portion)
6 First adapter
612 Flange portion
613 Recessed portion (coupling portion)
7 Second adapter
73 First protrusion portion (first coupling portion)
74 Second protrusion portion (second coupling portion)
9 Fastener (fixing member)

The invention claimed is:

1. A golf club comprising:

a shaft;

a golf club head having a hosel portion and an opening portion that is formed on a side opposite to the hosel portion and is in communication with an interior space of the hosel portion, the interior space being open at a shaft attachment hole of the hosel portion, and the golf club head having a hosel coupling portion in a vicinity of an opening of the attachment hole;

a first adapter that has a first end portion and a second end portion, the first adapter having a shaft receiving recessed portion to which the shaft is to be fixed and that is open on a first end portion side, the first end portion having a coupling portion, and the second end portion being accommodated in the interior space of the hosel portion through the attachment hole;

a second adapter that has a first end portion and a second end portion at respective ends along a first axis and has a through-hole through which the first adapter passes, the first end portion having a first coupling portion that is to be detachably coupled to the coupling portion of the first adapter, and the second end portion having a second coupling portion that is to be detachably coupled to the hosel coupling portion; and a fixing member that detachably fixes the first adapter in the interior space of the hosel portion, wherein the shaft is configured to be coupled with an inclination relative to the coupling portion of the first adapter, the first adapter is configured to be coupled with an inclination relative to the second adapter, the coupling portion of the first adapter and the first coupling portion of the second adapter can be coupled in a plurality of rotation positions about an axis, the second coupling portion of the second adapter and the hosel coupling portion can be coupled in a plurality of rotation position about an axis, the coupling portion of the first adapter and the first coupling portion of the second adapter are coupled outside the hosel portion, and the second adapter has the first end portion and the second end portion at respective ends along the first axis and is formed with a tubular shape along the first axis, and the through-hole of the second adapter is formed along a second axis that intersects the first axis.

2. The golf club according to claim 1, wherein the first adapter has the first end portion and the second end portion at respective ends along the first axis and is formed with a tubular shape along the first axis, and the shaft receiving recessed portion extends along a second axis that intersects the first axis.

3. The golf club according to claim 2, wherein the second adapter is formed with a ring shape, and is arranged along the attachment hole such that at least a portion is exposed to the outside.

4. The golf club according to claim 3, wherein the coupling portion of the first adapter is formed by a flange portion that projects radially outward, and the flange portion is coupled to the first coupling portion of the second adapter.

5. The golf club according to claim 4, wherein a protrusion/recession portion is formed on the flange portion of the first adapter along a circumferential direction, and a protrusion/recession portion that engages with the protrusion/recession portion of the flange portion is formed on the first coupling portion of the second adapter so as to be visible from the outside.

6. The golf club according to claim 5, wherein a protrusion/recession portion that extends along a circumferential direction of the attachment hole is formed on the hosel coupling portion, and a protrusion/recession portion that engages with the protrusion/recession portion of the hosel coupling portion is formed on the second coupling portion of the second adapter.

7. The golf club according to claim 2, wherein the coupling portion of the first adapter is formed by a flange portion that projects radially outward, and the flange portion is coupled to the first coupling portion of the second adapter.

8. The golf club according to claim 1, wherein the second adapter is formed with a ring shape, and is arranged along the attachment hole such that at least a portion is exposed to the outside.

9. The golf club according to claim 8, wherein the coupling portion of the first adapter is formed by a flange portion that projects radially outward, and the flange portion is coupled to the first coupling portion of the second adapter.

10. The golf club according to claim 1, wherein the coupling portion of the first adapter is formed by a flange portion that projects radially outward, and the flange portion is coupled to the first coupling portion of the second adapter.

11. The golf club according to claim 10, wherein a protrusion/recession portion is formed on the flange portion of the first adapter along a circumferential direction, and a protrusion/recession portion that engages with the protrusion/recession portion of the flange portion is formed on the first coupling portion of the second adapter so as to be visible from the outside.

12. The golf club according to claim 1, wherein a protrusion/recession portion that extends along a circumferential direction of the attachment hole is formed on the hosel coupling portion, and a protrusion/recession portion that engages with the protrusion/recession portion of the hosel coupling portion is formed on the second coupling portion of the second adapter.

* * * * *